US011230113B2

(12) United States Patent
Nakamura

(10) Patent No.: US 11,230,113 B2
(45) Date of Patent: Jan. 25, 2022

(54) LIQUID DISCHARGE APPARATUS

(71) Applicant: Daisuke Nakamura, Kanagawa (JP)

(72) Inventor: Daisuke Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/005,269

(22) Filed: Aug. 27, 2020

(65) Prior Publication Data

US 2021/0070059 A1 Mar. 11, 2021

(30) Foreign Application Priority Data

Sep. 10, 2019 (JP) ..... JP2019-164214

(51) Int. Cl.
*B41J 2/175* (2006.01)
*B41J 25/00* (2006.01)

(52) U.S. Cl.
CPC ..... *B41J 2/17566* (2013.01); *B41J 2/17513* (2013.01); *B41J 2/17523* (2013.01); *B41J 2/17553* (2013.01); *B41J 2002/17579* (2013.01); *B41J 2025/008* (2013.01)

(58) Field of Classification Search
CPC .... B41J 2/175; B41J 2/17503; B41J 2/17506; B41J 2/17509; B41J 2/17513; B41J 2/17523; B41J 2/17553; B41J 2/17566; B41J 2002/17579; B41J 2025/008
See application file for complete search history.

(56) References Cited

U.S. PATENT DOCUMENTS 6,113,228 A * 9/2000 Pawlowski, Jr. .... B41J 2/17556 347/81
6,209,980 B1 * 4/2001 Kobayashi ..... B41J 2/17513 347/7
8,657,395 B2 * 2/2014 Masunaga ..... B41J 2/17513 347/6
8,777,342 B2 * 7/2014 Matsubara ..... B41J 2/17566 347/7
9,079,439 B2 7/2015 Leoni et al.
10,252,535 B2 4/2019 Kobayashi et al.
2003/0128256 A1 * 7/2003 Oda ..... B41J 2/17513 347/85

(Continued)

FOREIGN PATENT DOCUMENTS

JP 2004155151 A 6/2004
JP 2017-209844 11/2017
JP 2017209844 A 11/2017

OTHER PUBLICATIONS

U.S. Appl. No. 16/806,675, filed Mar. 2, 2020 Daisuke Nakamura.
European Search Report; Application EP20192837; dated Jan. 18, 2021.

*Primary Examiner* — Anh T Vo
(74) *Attorney, Agent, or Firm* — Duft & Bornsen, PC

(57) ABSTRACT

A liquid discharge apparatus includes a plurality of head units configured to discharge a liquid, a plurality of sub tanks configured to respectively store the liquid to be supplied to the plurality of head units, and a plurality of upper limit detectors configured to respectively detect upper limits of remaining amounts of liquid in the plurality of sub tanks. At least two of the plurality of upper limit detectors of corresponding at least two of the plurality of sub tanks detect different upper limits of the remaining amounts of liquid in the at least two of the plurality of sub tanks.

11 Claims, 15 Drawing Sheets

(56) References Cited

U.S. PATENT DOCUMENTS

| | | | | |
|---|---|---|---|---|
| 2006/0139384 | A1* | 6/2006 | Kitabatake | B41J 2/17553 347/7 |
| 2009/0290002 | A1* | 11/2009 | Katoh | B41J 2/17509 347/85 |
| 2011/0141209 | A1 | 6/2011 | Tsukamura et al. | |
| 2011/0228016 | A1 | 9/2011 | Nakamura | |
| 2011/0310184 | A1* | 12/2011 | Nakamura | B41J 2/17509 347/85 |
| 2012/0056953 | A1 | 3/2012 | Nakamura | |

* cited by examiner 1
1007
1007
1007

LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-164214, filed on Sep. 10, 2019, in the Japan Patent Office, the entire disclosures of which is hereby incorporated by reference herein.

BACKGROUND

Technical Field

Aspect of this disclosure relates to a liquid discharge apparatus.

Related Art

A liquid discharge apparatus, such as a printer includes a plurality of heads that discharges a liquid, sub tanks (liquid containers) to temporarily store the liquids to be supplied to the plurality of heads, and a drum to convey a sheet. The plurality of heads is disposed around the drum such that the plurality of heads is inclined at different angles.

Heights of the sub tanks are different according to inclinations of the plurality of heads so that water heads between the plurality of heads and the sub tanks are equalized to reduce variation of negative pressure applied on the plurality of heads.

SUMMARY

In an aspect of this disclosure, a liquid discharge apparatus includes a plurality of head units configured to discharge liquids, a plurality of sub tanks configured to respectively store the liquids to be supplied to the plurality of head units, and a plurality of upper limit detectors configured to respectively detect upper limits of remaining amounts of liquid in the plurality of sub tanks. At least two of the plurality of upper limit detectors of corresponding at least two of the plurality of sub tanks detect different upper limits of the remaining amounts of liquid in the at least two of the plurality of sub tanks.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
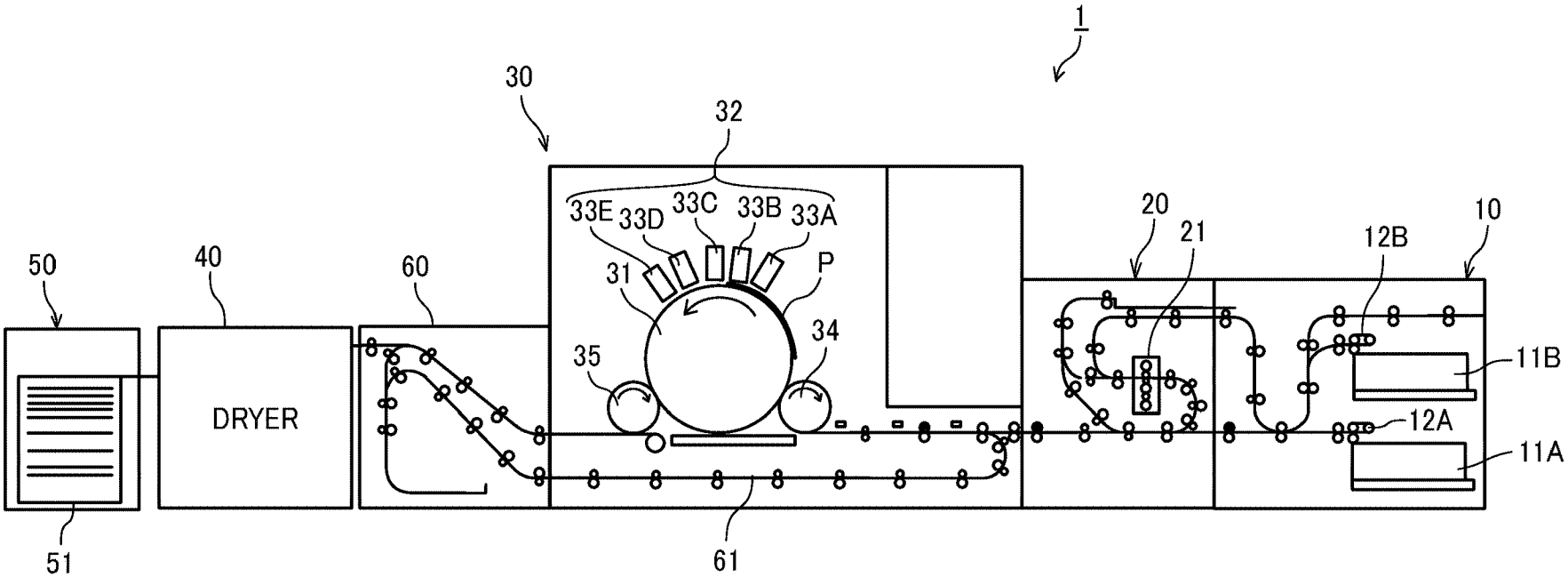
FIG. 1 is a schematic cross-sectional front view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Referring now to the drawings, wherein like reference numerals designate identical or corresponding parts throughout the several views, embodiments of the present disclosure are described below.

If the sub tank that temporarily stores the liquid to be supplied to the head is arranged to be inclined as the head, a height of a liquid level in the sub tank varies according to a degree of inclination of the sub tank.

Therefore, a problem occurs in which the water head difference between the head and the sub tank varies, and the negative pressure varies between the heads.

Figure 2:
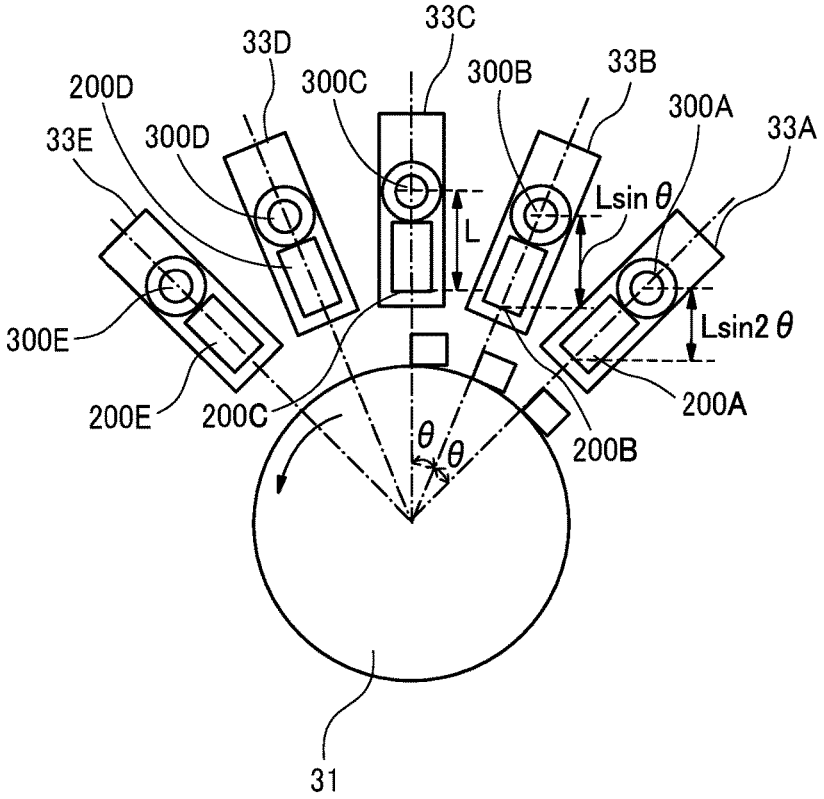
FIG. 2 is an enlarged cross-sectional front view of a portion of a printing unit of the printer.

A printer 1 as a liquid discharge apparatus according to a first embodiment of the present disclosure is described with reference to FIGS. 1 and 2. FIG. 1 is a schematic cross-sectional front view of the printer 1 according to the first embodiment of the present disclosure. FIG. 2 is an enlarged cross-sectional front view of a portion of a printing unit 30 of the printer 1.

A printer 1 according to the first embodiment includes a loading unit 10 to load a sheet P into the printer 1, a pretreatment unit 20, a printing unit 30, a dryer 40, and an ejector 50, and a reverse mechanism 60. In the printer 1, the pretreatment unit 20 applies, as required, pretreatment liquid onto the sheet P fed (supplied) from the loading unit 10, the printing unit 30 applies liquid to the sheet P to perform required printing, the dryer 40 dries the liquid adhering to the sheet P, and the sheet P is ejected to the ejector 50.

The loading unit 10 includes loading trays 11 (a lower loading tray 11A and an upper loading tray 11B) to accommodate a plurality of sheets P and feeding units 12 (a feeding unit 12A and a feeding unit 12B) to separate and feed the sheets P one by one from the loading trays 11, and supplies the sheets P to the pretreatment unit 20.

The pretreatment unit 20 includes, e.g., a coater 21 as a treatment-liquid application unit that coats a printing surface of a sheet P with a treatment liquid having an effect of aggregation of ink particles to prevent bleed-through.

The printing unit 30 includes a drum 31 and a liquid discharge unit 32. The drum 31 is a bearer (rotating member) that bears the sheet P on a circumferential surface of the drum 31 and rotates. The liquid discharge unit 32 discharges a liquid toward the sheet P borne on the drum 31.

The printing unit 30 includes transfer cylinders 34 and 35. The transfer cylinder 34 receives the sheet P fed from the pretreatment unit 20 and forwards the sheet P to the drum 31. The transfer cylinder 35 receives the sheet P conveyed by the drum 31 and forwards the sheet P to the reverse mechanism 60.

The transfer cylinder 34 includes a sheet gripper to grip a leading end of the sheet P conveyed from the pretreatment unit 20 to the printing unit 30. The sheet P thus gripped is conveyed as the transfer cylinder 34 rotates. The transfer cylinder 34 forwards the sheet P to the drum 31 at a position opposite (facing) the drum 31.

Similarly, the drum 31 includes a sheet gripper on a surface of the drum 31, and the leading end of the sheet P is gripped by the sheet gripper of the drum 31. The drum 31 has a plurality of suction holes dispersedly on a surface of the drum 31, and a suction unit generates suction airflows directed inward from suction holes of the drum 31.

On the drum 31, the sheet gripper grips the leading end of the sheet P forwarded from the transfer cylinder 34, and the sheet P is attracted to and borne on the drum 31 by the suction airflows by the suction unit. As the drum 31 rotates, the sheet P is conveyed.

The liquid discharge unit 32 includes discharge units 33 (33A to 33E) to discharge liquids of each color, for example, yellow (Y), cyan (C), magenta (M), and black (K). For example, the discharge unit 33A discharges a liquid of black (K), the discharge unit 33B discharges a liquid of cyan (C), the discharge unit 33C discharges a liquid of magenta (M), and the discharge unit 33D discharges a liquid of yellow (Y), respectively. In addition, a discharge unit 33E is used to discharge a special liquid, that is, a liquid of spot color such as white, gold, or silver.

As illustrated in FIG. 2, each discharge unit 33 (33A to 33E) of the liquid discharge unit 32 includes a head unit 200 (head module or head array) that discharges a liquid and a sub tank 300 (300A to 300E) that stores the liquid supplied to the head unit 200. The sub tank 300 is also referred to as the liquid container.

Here, each of the discharge unit 33A to 33E is arranged in a normal direction to the center of the drum 31. The printer 1 according to the first embodiment includes the discharge unit 33C in a vertical direction passing through the center of the drum 31. The discharge units 33A, 33B, 33D, and 33E are arranged at a predetermined angle θ with respect to the discharge unit 33C as a reference.

The printer 1 controls the discharge operation of each of the discharge units 33 of the liquid discharge unit 32 by a drive signal corresponding to print data. When the sheet P borne on the drum 31 passes through a region facing the liquid discharge unit 32, the liquids of respective colors are discharged from the discharge units 33, and an image corresponding to the print data is formed.

The reverse mechanism 60 reverses, in switchback manner, the sheet P that has passed through the transfer cylinder 35 in double-sided printing. The reversed sheet P is fed back to an upstream side of the transfer cylinder 34 through a conveyance passage 61 of the printing unit 30.

The dryer 40 dries the liquid applied onto the sheet P by the printing unit 30. Thus, the liquid component such as water in the liquid evaporates, the colorant contained in the liquid is fixed on the sheet P. Thus, curling of the sheet P is reduced.

The ejector 50 includes an ejection tray 51 on which a plurality of sheets P is stacked. The plurality of sheets P conveyed from the dryer 40 is sequentially stacked and held on the ejection tray 51.

Figure 3:
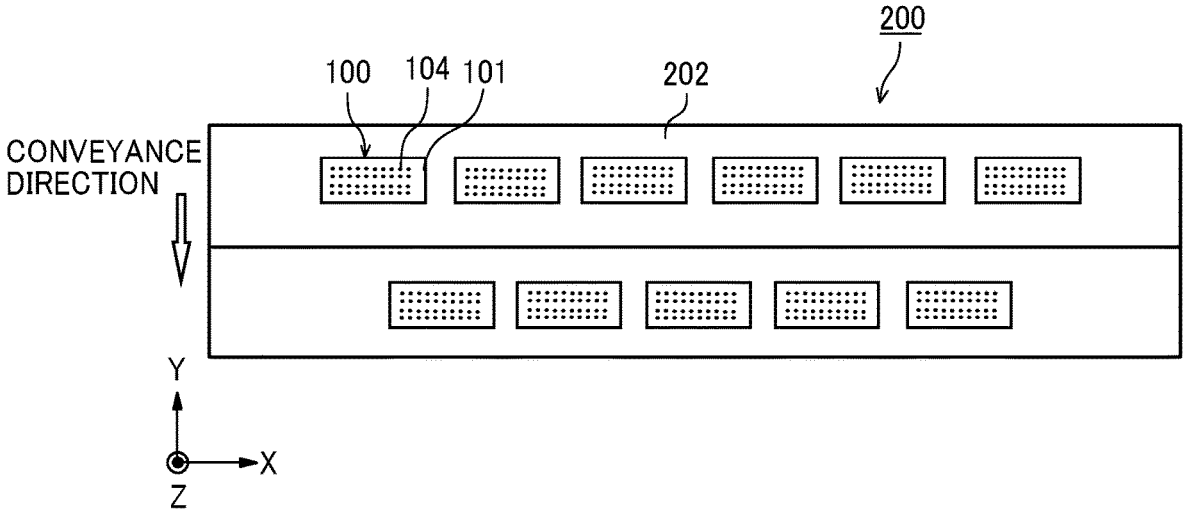
FIG. 3 is a plan view of a head unit configuring a discharge unit of the printer viewed from a nozzle surface side of the head unit.

Next, an example of the head unit (head unit or head array) that configures the discharge unit is described with reference to FIG. 3. FIG. 3 is a plan view of the head unit 200 viewed from a nozzle surface side of the head 100.

In each of the head unit 200, a plurality of heads 100 is arranged in a staggered manner in a head array direction on a base member 202. Each of the plurality of heads 100 discharges a liquid. The head array direction is indicated by arrow "X" in FIG. 3. Further, a conveyance direction of the sheet P is perpendicular to the head array direction X. The conveyance direction is indicated by arrow "Y" in FIG. 3.

The head 100 includes a plurality of nozzle arrays in which a plurality of nozzles 104, from which the liquid is discharged, is arrayed. A number of nozzle arrays is not limited to four as illustrated in FIG. 3 and may be any number.

The head unit 200 according to the first embodiment includes the heads 100 in a staggered manner. Thus, the heads 100 in each row are arranged in the normal direction to the center of the drum 31. Further, a nozzle surface 101 (discharge surface) of each head 100 is inclined so that the nozzle surface 101 is in a direction of a tangential direction of the circumferential surface of the drum 31.

Figure 4:
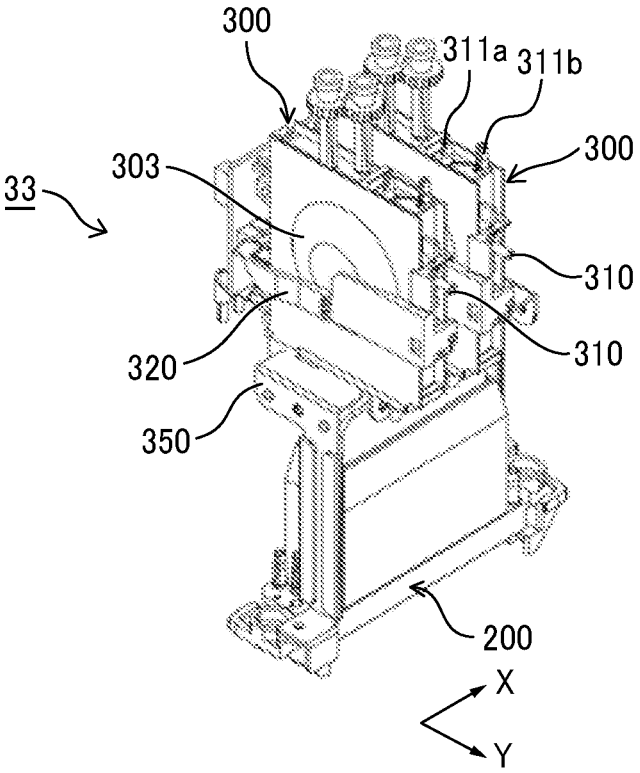
FIG. 4 is a schematic perspective view of the discharge unit.
Figure 5:
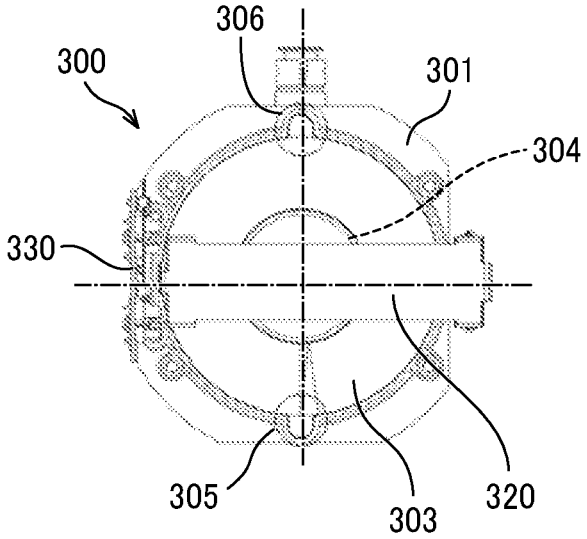
FIG. 5 is a schematic front view of a sub tank configuring the discharge unit.
Figure 6:
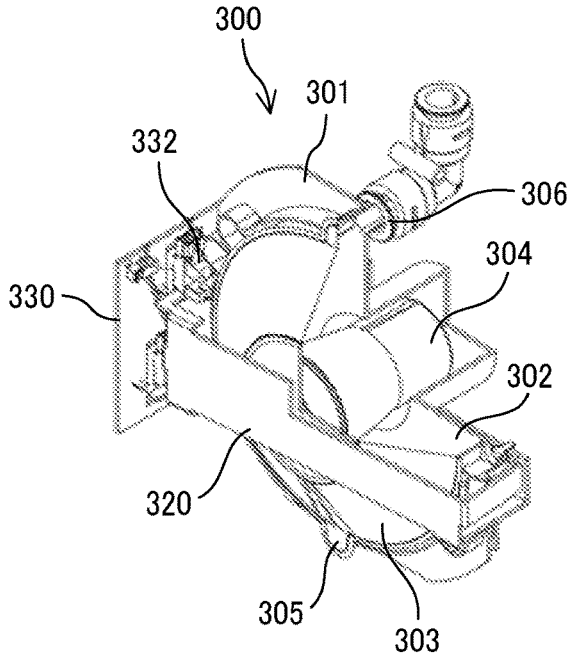
FIG. 6 is a schematic partial cross-sectional perspective view of the sub tank.

Next, an example of a discharge unit and a sub tank according to a first embodiment of the present disclosure is described with reference to FIGS. 4 to 6 are described below. FIG. 4 is a schematic perspective view of the discharge unit 33. FIG. 5 is a schematic cross-sectional front view of the sub tank 300 according to the first embodiment of the present disclosure. FIG. 6 is a schematic partial cross-sectional perspective view of the sub tank 300.

As illustrated in FIG. 4, each of the discharge unit 33 includes the head unit 200 and two sub tanks 300 on the fixing member 350. The two sub tanks 300 are arranged side by side in the head array direction X of the head unit 200.

Each of the sub tank 300 includes a tank case 301 (see FIG. 5) that configures the liquid container 302 to accommodate a liquid. The tank case 301 includes an opening on one surface side of the tank case 301. The opening of the tank case 301 is sealed with a flexible film 303 serving as a flexible member.

The liquid container 302 in the sub tank 300 includes an elastic member 304 such as a spring. The elastic member 304 in the sub tank 300 urges (pushes) the flexible film 303 in an out-of-plane direction outside the tank case 301 from the opening sealed by the flexible film 303. When a remaining amount of liquid in the liquid container 302 decreases, the flexible film 303 is pushed in the out-of-plane direction outside the tank case 301 from the opening sealed by the elastic member 304.

The tank case 301 includes a liquid supply port 305 on a bottom part of the tank case 301. A connector is detachably connected to the liquid supply port 305 of the tank case 301 so that a liquid is supplied from a main tank to the connector with pressure. Thus, the liquid is replenished in the liquid container 302. The discharge unit 33 includes a liquid feed pump 562 (see FIG. 15) between the main tank and the sub tank 300. The liquid feed pump 562 feeds the liquid from the main tank to the sub tank 300 with pressure. The liquid feed pump 562 is also referred to as a "feed unit". The liquid feed pump 562 feeds the liquid from the main tank to the liquid supply port 305 of the tank case 301.

The tank case 301 includes a liquid discharge port 306 on a top part of the tank case 301. The liquid discharge port 306 discharges the liquid supplied from the sub tank 300 to the head 100 by the generation of negative pressure. The liquid discharge port 306 and a manifold to distribute the liquid to each head 100 are connected by a tube and the like. The liquid discharged from the sub tank 300 is distributed and supplied to each head 100.

The sub tank 300 includes an air release mechanism 310 on an upper part of the tank case 301. The air release mechanism 310 serves as an air release unit to release an interior of the sub tank 300 with outside air. When the air release mechanism 310 is opened, the liquid container 302 is opened to the atmosphere (negative pressure is released). Conversely, when the air release mechanism 310 is closed, the liquid container 302 is closed from the atmosphere so that the negative pressure is generable.

The sub tank 300 includes two detection electrodes 311 (311*a* and 311*b*) on an upper part of the tank case 301. The detection electrodes 311 detect that a remaining amount of liquid in the liquid container 302 has become equal to or less than a predetermined amount. A state of the liquid in the liquid container 302 in which the remaining amount of the liquid become equal to or less than the predetermined amount is referred to as "ink end state" or "ink near end state." The "ink end state" and the "ink near end state" are collectively referred to as "an ink end state." Thus, the printer 1 detects whether the detection electrodes 311*a* and 311*b* are in a conductive state through the liquid to determine whether the liquid in the liquid container is in the ink end state. If the detection electrodes 311*a* and 311*b* are in a non-conductive state (not in the conductive state), the liquid in the liquid container is in the ink end state.

Figure 7:
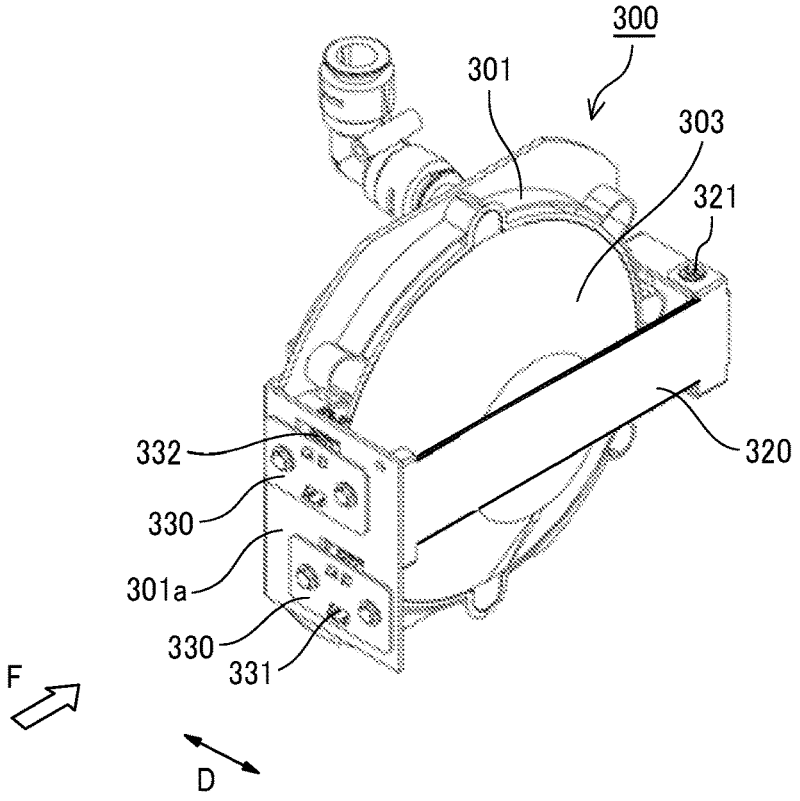
FIG. 7 is an external schematic perspective view of the sub tank illustrating a remaining amount detector of the sub tank.
Figure 8:
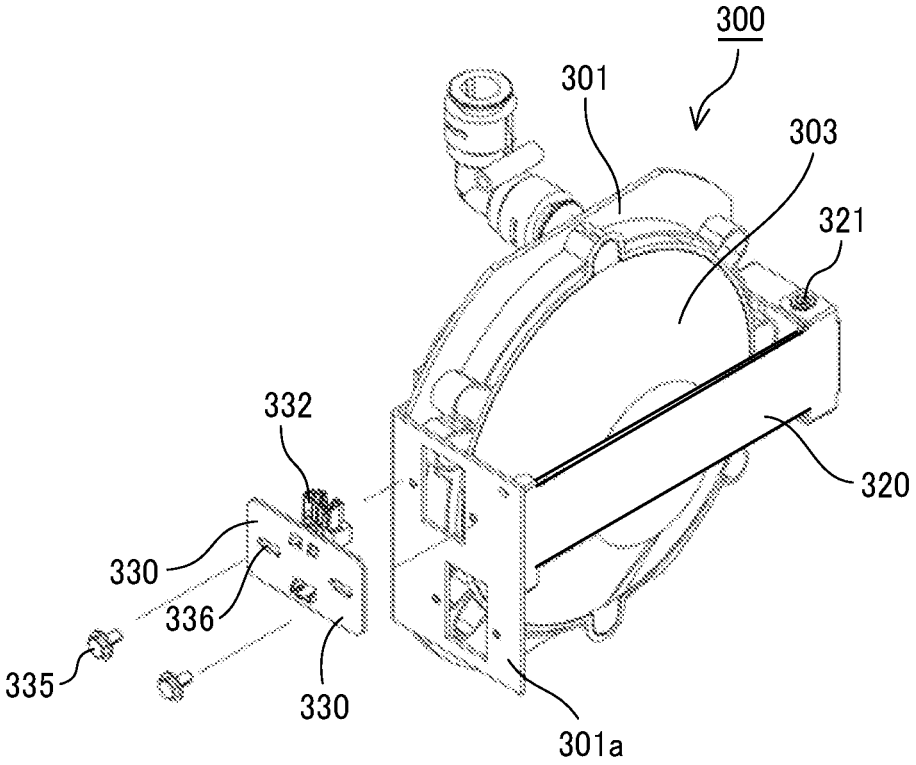
FIG. 8 is an exploded schematic partial perspective view of the remaining amount detector of the sub tank.

Next, a remaining amount detector of the sub tank 300 is described with reference to FIGS. 7 and 8. FIG. 7 is a schematic cross-sectional perspective view of the sub tank 300 according to the first embodiment of the present disclosure. FIG. 8 is a schematic partial cross-sectional perspective view of the sub tank 300.

The sub tank 300 includes a displacement member 320 on an outside the flexible film 303 of the tank case 301. The displacement member 320 is configured by a feeler, one end of which is swingably supported by a shaft 321.

The displacement member 320 is pressed toward the tank case 301 by a pressing member such as a spring so that the displacement member 320 is pressed against the flexible film 303 to contact an outer surface of the flexible film 303 of the tank case 301. Thus, the displacement member 320 displaces according to a movement of the flexible film 303 that displaces according to the remaining amount of the liquid in the liquid container 302.

The sub tank 300 further includes sensor holders 330 (sensor brackets) attached to a fixing portion 301*a* of the tank case 301 (see FIG. 7). The sensor holder holders 330 are also referred to as the "detector holders."

The sensor holders 330 respectively hold an upper limit sensor 331 and a lower limit sensor 332. The upper limit sensor 331 serves as an upper limit detector to detect the displacement member 320 at an upper limit position. The lower limit sensor 332 serves as a lower limit detector to detect the displacement member 320 at a lower limit position. The lower limit sensor 332 is to the left of the upper limit sensor 331 in FIG. 7, that is an interior of the tank case 301.

Conversely, the upper limit sensor 331 is disposed in an exterior of the tank case 301, that is right side of the lower limit sensor 332 in FIG. 7.

The upper limit sensor 331 detects the displacement member 320 when the displacement member 320 is displaced to a position corresponding to a predetermined upper limit position (full position) of the amount of remaining liquid in the liquid container 302. The lower limit sensor 332 detects the displacement member 320 when the displacement member 320 is displaced to a position corresponding to a predetermined lower limit position (empty position) of the remaining amount of liquid in the liquid container 302.

The upper limit sensor 331, the lower limit sensor 332, and the displacement member 320 configure the remaining amount detector according to the first embodiment of the present disclosure.

The sensor holders 330 are detector holders to respectively hold the upper limit sensor 331 and the lower limit sensor 332. As illustrated in FIG. 8, a fastener 335 is fastened to the fixing portion 301*a* through the elongated hole 336 in the sensor holder 330 so that the sensor holder 330 is fixed to the fixing portion 301*a*.

The sensor holders 330 hold the upper limit sensor 331 and the lower limit sensor 332. The sensor holders 330 can adjust a fixing position of the upper limit sensor 331 and the lower limit sensor 332 with respect to the fixing portion 301*a* in a displacement direction indicated by arrow "D" (see FIG. 7) of the displacement member 320 by an elongated hole 336 (see FIG. 8). Thus, the printer 1 can adjust the detection position of the displacement member 320 by the upper limit sensor 331 and the lower limit sensor 332.

Thus, the printer 1 can change (adjust) an upper limit detection position of the upper limit sensor 331 and a lower limit detection position of the lower limit sensor 332. The upper limit sensor 331 detects the displacement member 320 at the upper limit detection position. The lower limit sensor 332 detects the displacement member 320 at the lower limit detection position.

Figure 9:
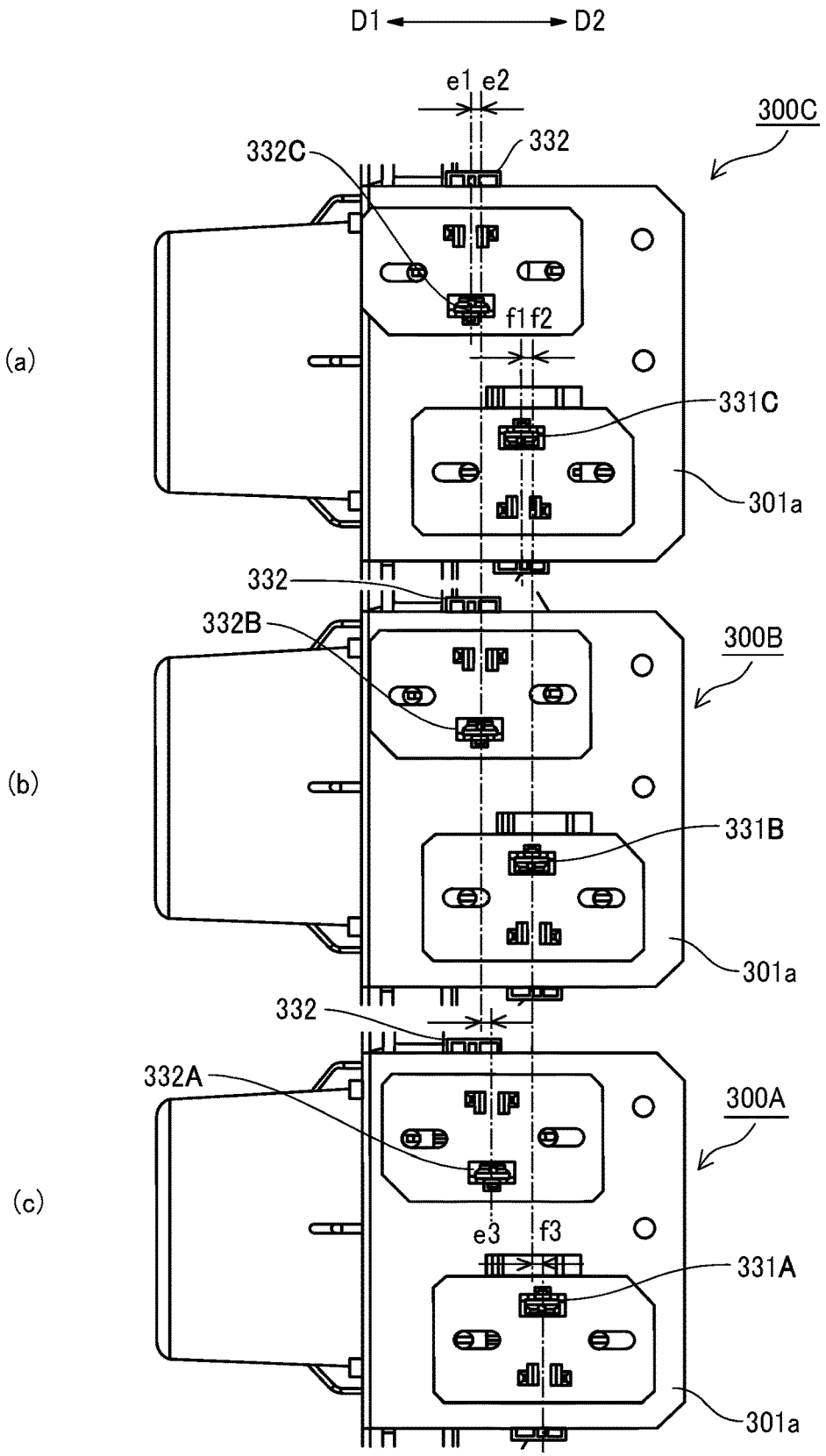
FIG. 9 is a schematic front view of relative attachment positions (detection positions) of upper limit sensors and lower limit sensors of a plurality of the discharge units according to the second embodiment in a view from a direction indicated by arrow "F" in FIG. 7.

Next, a relative attachment positions (detection positions) of the upper limit sensor 331 and the lower limit sensor 332 in each of the plurality of discharge unit 33 is described below with reference to FIG. 9. FIG. 9 is a schematic front view of the upper limit sensors 331 and the lower limit sensors 332 in a view from a direction indicated by arrow "F" in FIG. 7.

In FIG. 9, the displacement member 320 of the sub tank 300 is displaced in a direction indicted by arrow "D1" as the remaining amount of liquid in the liquid container 302 is decreased. Further, the displacement member 320 of the sub tank 300 is displaced in a direction indicted by arrow "D2" as the remaining amount of liquid in the liquid container 302 is increased.

As illustrated in FIG. 9(*a*), the upper limit sensor 331 and the lower limit sensor 332 of the sub tank 300C of the discharge unit 33C are arranged (aligned) in a vertical direction. The upper limit sensor 331 and the lower limit sensor 332 of the sub tank 300C respectively detect the displacement member 320 at an upper limit detection position f1 and a lower limit detection position e1.

The discharge units 33B is arranged at an angle θ with respect to the discharge unit 33C as a reference (see FIG. 2). Therefore, as illustrated in FIG. 9(*b*), the upper limit sensor 331 and the lower limit sensor 332 of the sub tank 300B respectively detects the displacement member 320 at an upper limit detection position f2 and a lower limit detection position e2.

The remaining amount of liquid in the sub tank 300B at the upper limit detection position f2 is larger than the remaining amount of liquid in the sub tank 300C at an upper limit detection position f1 of the sub tank 300C of the discharge unit 33C. Further, the remaining amount of liquid in the sub tank 300B at the lower limit detection position e2 is larger than the remaining amount of liquid in the sub tank 300C at a lower limit detection position e1 of the sub tank 300C of the discharge unit 33C.

The discharge unit 33A is arranged at an angle θ with respect to the discharge unit 33B (see FIG. 2). As illustrated in FIG. 9(*c*), the upper limit sensor 331 and the lower limit sensor 332 of the sub tank 300A respectively detects the displacement member 320 at an upper limit detection position f3 and a lower limit detection position e3.

The remaining amount of liquid in the sub tank 300A at the upper limit detection position f3 is larger than the remaining amount of liquid in the sub tank 300B at the upper limit detection position f2 of the sub tank 300B of the discharge unit 33B. Further, the remaining amount of liquid in the sub tank 300A at the lower limit detection position e3 is larger than the remaining amount of liquid in the sub tank 300B at the lower limit detection position e2 of the sub tank 300B of the discharge unit 33B.

Figure 10:
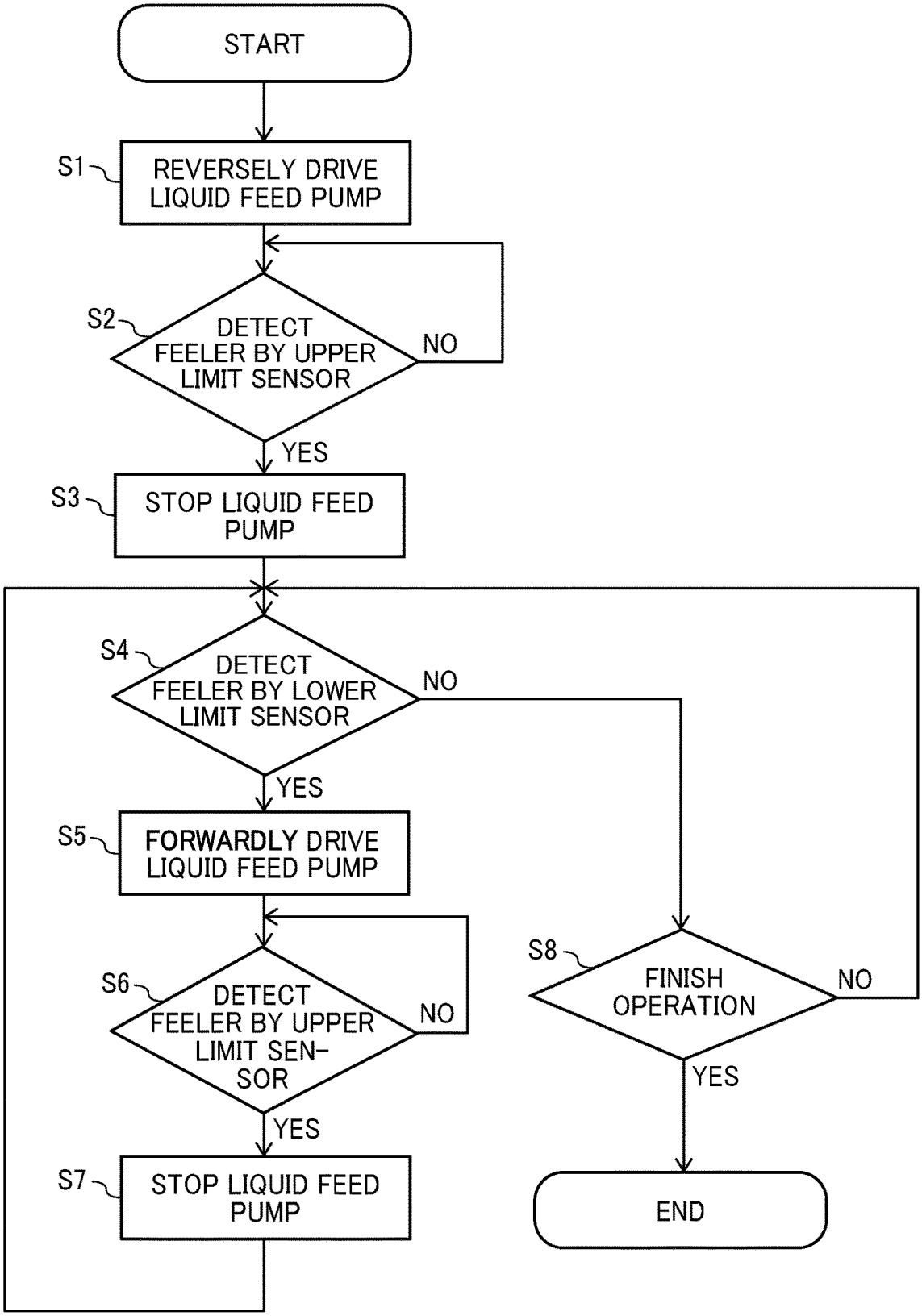
FIG. 10 is a flowchart of an example of a control of supply operation of the liquid to the sub tank.

FIG. 10 is a flowchart of an example of a control of supply operation of the liquid to the sub tank 300.

The liquid feed pump 562 feeds the liquid to the sub tank 300, until the detection electrodes 311*a* and 311*b* detects the liquid after the air release mechanism 310 release the interior of the tank case 301 to the atmosphere, to fill-up the liquid container 302 with the liquid. Then, the printer 1 reversely drives the liquid-sending pump 562 as described below to reversely feed the liquid from the sub tank 300 to the main tank 500 (see FIG. 15) as described below (step S1, hereinafter simply referred to as "S1"). Thus, the liquid feed pump 562 feeds the liquid in a reverse direction from the sub tank 300 to the main tank 500.

Then, the printer 1 determines whether the upper limit sensor 331 detects the displacement member 320 (S2). The displacement member 320 is indicated as a "feeler" in FIG. 10. The printer 1 stops the liquid feed pump 562, after feeding the liquid in the reverse direction for a predetermine amount after the upper limit sensor 331 detects the displacement member 320 (S3). The liquid feed pump 562 is continuously reversely driven from the step S1 to the step S3.

Then, the printer 1 determines whether the lower limit sensor 332 detects the displacement member 320 (S4). The printer 1 forwardly drives the liquid feed pump 562 to feed the liquid to the sub tank 300 (S5) when the lower limit sensor 332 detects the displacement member 320 (S4, YES).

The printer 1 determines whether the upper limit sensor 331 detects the displacement member 320 (S6) and forwardly drives the liquid feed pump 562 to feed the liquid to the liquid container 302 of the sub tank 300 until the upper limit sensor 331 detects the displacement member 320 (S6, YES). The printer 1 stops the liquid feed pump 562 (S7) when the upper limit sensor 331 detects the displacement member 320 (S6, YES), and a process of supply operation returns to the step S4. The liquid feed pump 562 is continuously forwardly driven from the step S5 to the step S7.

When the lower limit sensor 332 does not detect the displacement member 320 (S4, NO), the printer 1 determines whether the supply operation of the printer 1 is finished such as a stop of an apparatus (S8). A process of returning to the step S4 (supply operation) is repeated until the supply operation is completed (S8, YES).

Thus, the printer 1 controls the supply operation from the main tank 500 to the sub tank 300 within a control range between the upper limit position at which the upper limit sensor 331 detects the displacement member 320 and the lower limit position at which the lower limit sensor 332 detects the displacement member 320. The control range as described-above becomes a proper control range of the negative pressure in the sub tank 300.

Figure 11:
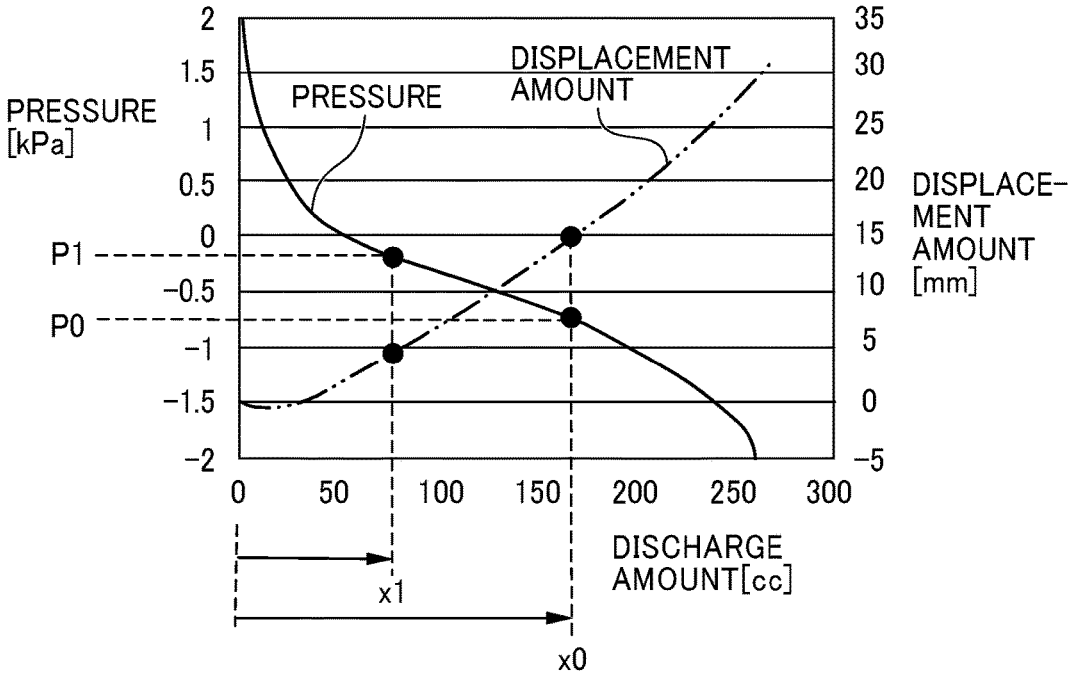
FIG. 11 is a graph illustrating an example of a relation (drainage characteristics) between a discharge amount of the liquid from the sub tank, a displacement amount of a displacement member, and a pressure change in the sub tank.

Next, an effect of the control range of the negative pressure according to the first embodiment is described with reference to FIGS. 11 and 12. FIG. 11 is a graph illustrating an example of a relation (drainage characteristics) between a discharge amount of the liquid from the sub tank 300, a displacement amount of the displacement member 320, and a pressure change in the sub tank 300. FIG. 12 is a schematic top view of the sub tank 300 to illustrate a state of the displacement member 320 of the sub tank 300 at positions X0 and X1 in FIG. 11.

With reference to FIG. 2 as described above, each of the discharge unit 33A to 33E is arranged in the normal direction to the center of the drum 31. The discharge units 33A, 33B, 33D, and 33E are arranged at the predetermined angle θ with respect to the discharge unit 33C as the reference.

The discharge unit 33 includes the sub tank 300 above the nozzle surface 101 of the head 100 of the head unit 200. Therefore, a water head difference between a center of the sub tank 300 and the nozzle surface 101 of each of the discharge units 33A to 33E is different according to an inclination angle of the discharge unit 33.

For example, when the water head difference between the center of the sub tank 300 and the nozzle surface 101 is "L", the water head difference between the sub tank 300C and the nozzle surface 101 becomes "L" in the discharge unit 33C having an inclination angle of zero degree as illustrated in FIG. 2.

Thus, it can be said that a first head 100 and the sub tank 300C connected to the first head 100 is inclined at a first angle including zero degree, and the first head 100 is aligned with the vertical direction.

The discharge unit 33B is arranged at the angle θ with respect to the discharge unit 33C so that the water head difference between the center of the sub tank 300B and the nozzle surface 101 becomes L sin θ as illustrated in FIG. 2. Similarly, the discharge unit 33D is arranged at the angle θ with respect to the discharge unit 33C so that the water head difference between the center of the sub tank 300D and the nozzle surface 101 becomes L sin θ as illustrated in FIG. 2. The discharge unit 33A is arranged at the angle 2θ with respect to the discharge unit 33C so that the water head difference between the center of the sub tank 300A and the nozzle surface 101 becomes L sin 2θ as illustrated in FIG. 2. Similarly, the discharge unit 33E is arranged at the angle 2θ with respect to the discharge unit 33C so that the water head difference between the center of the sub tank 300E and the nozzle surface 101 becomes L sin 2θ as illustrated in FIG. 2. As described above, the discharge unit 33 in the first embodiment has different water head differences between the plurality of head units 200 (discharge units 33). The water head difference is generated between the nozzle surface 101 of the head 100 and the sub tank 300.

Here, a lower limit value (a side closer to the positive pressure) of a proper negative pressure of the head 100 of the discharge unit 33 is defined as "P." Then, the negative pressure "P0" required for the sub tank 300C of the discharge unit 33C arranged in the vertical direction becomes −(P+L) [kPa] that are a sum of the proper negative pressure P and the water head difference L between the nozzle surface 101 of the head 100 and the center of the sub tank 300C. The negative pressure P0 is also referred to as "in-tank negative pressure."

Further, the in-tank negative pressure "P1" required for the sub tank 300B of the discharge unit 33B arranged at the angle θ with respect to the discharge unit 33C becomes −(P+L sin θ) [kPa] that are a sum of the proper negative pressure P and the water head difference L sin θ between the nozzle surface 101 of the head 100 and the center of the sub tank 300B.

Further, the in-tank negative pressure "P2" required for the sub tank 300A of the discharge unit 33A arranged at the angle 2θ with respect to the discharge unit 33C becomes −(P+L sin 20) [kPa] that are a sum of the proper negative pressure P and the water head difference L sin 2θ between the nozzle surface 101 of the head 100 and the center of the sub tank 300A.

Next, with reference to FIG. 11, the printer 1 drives the air release mechanism 310 to release the liquid container 302 of the sub tank 300 to the atmosphere (a state at left end in FIG. 11) and discharges the liquid from the liquid container 302 until the detection electrodes 311 detects the liquid surface of the liquid in the liquid container 302 from a state in which the liquid is filled-up in the liquid container 302. Thus, the flexible film 303 is displaced inward toward the tank case 301 against the biasing force of the elastic member 304 (increase in the displacement amount of the displacement member 320 in FIG. 11).

As a result, the displacement amount of the displacement member 320 increases as the discharge amount of the liquid from the sub tank 300 increases (see FIG. 11). Also, the pressure in the liquid container 302 decreases from a positive pressure to a negative pressure (increase in the negative pressure) as the discharge amount of the liquid from the sub tank 300 increases (see FIG. 11).

Figure 12A:
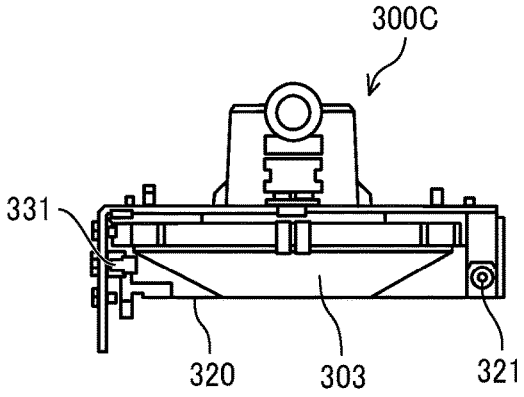
FIGS. 12A and 12B are schematic top views of the sub tank to illustrate a state of the displacement member of the sub tank at positions X0 and X1 in FIG. 11.

During a decrease in the pressure, a position of the displacement member 320 of the in-tank negative pressure P0 (P0=P0+L) of the sub tank 300C, at which the proper negative pressure P of the head 100 is obtained, becomes "X0" (see FIG. 11). Then, a state of the displacement member 320 of the sub tank 300C is, for example, as illustrated in FIG. 12A.

Figure 12B:
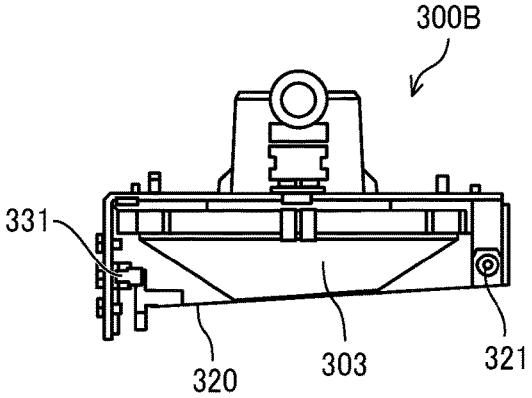

Conversely, a position of the displacement member 320 of the in-tank negative pressure P1 (P1=P0+L sin θ) of the sub tank 300B, at which the proper negative pressure P of the head 100 is obtained, becomes "X1" (see FIG. 11). Then, a state of the displacement member 320 of the sub tank 300B is, for example, as illustrated in FIG. 12B. As illustrated in FIGS. 12A and 12B, an amount of the liquid in the sub tank 300B is larger than an amount of the liquid in the sub tank 300C.

Thus, the discharge unit 33 having a larger inclination angle can obtain the proper negative pressure P with a smaller discharge amount of the liquid from the sub tank 300 compared to the discharge unit 33 having a smaller inclination angle.

Thus, the upper limit sensor 331 of the sub tank 300C of the discharge unit 33C is arranged at a position f1 (see FIG. 9) at which the upper limit sensor 331 detects the displacement member 320 at the position X0 of the displacement member 320. Further, the upper limit sensor 331 of the sub tank 300B of the discharge unit 33B is arranged at a position f2 (see FIG. 9) at which the upper limit sensor 331 detects the displacement member 320 at the position X1 of the displacement member 320.

As described above, the upper limit of the remaining amount of liquid in the sub tank 300 is differentiated according to a degree of inclination (inclination angle) of the discharge unit 33. The upper limit of the remaining amount of the liquid in the sub tank 300 is also referred to as "inner capacity") Thus, the printer 1 can reduce variation in the negative pressure of the head 100 caused by the difference in the water head difference between the center of the sub tank 300 and the nozzle surface 101.

Thus, the plurality of head units 200 and the plurality of sub tanks 300 are inclined at different angles to a vertical direction, and inner capacities of the plurality of sub tanks 300 are different according to the different angles of the plurality of head units 200.

Further, the printer 1 according to the first embodiment has the lower limits of the remaining amount of the liquid in the sub tanks 300 differentiated according to the degree of inclination of the discharge units 33. Thus, a displacement range of the displacement member 320 between the sub tanks 300 can be made uniform.

Figure 13:
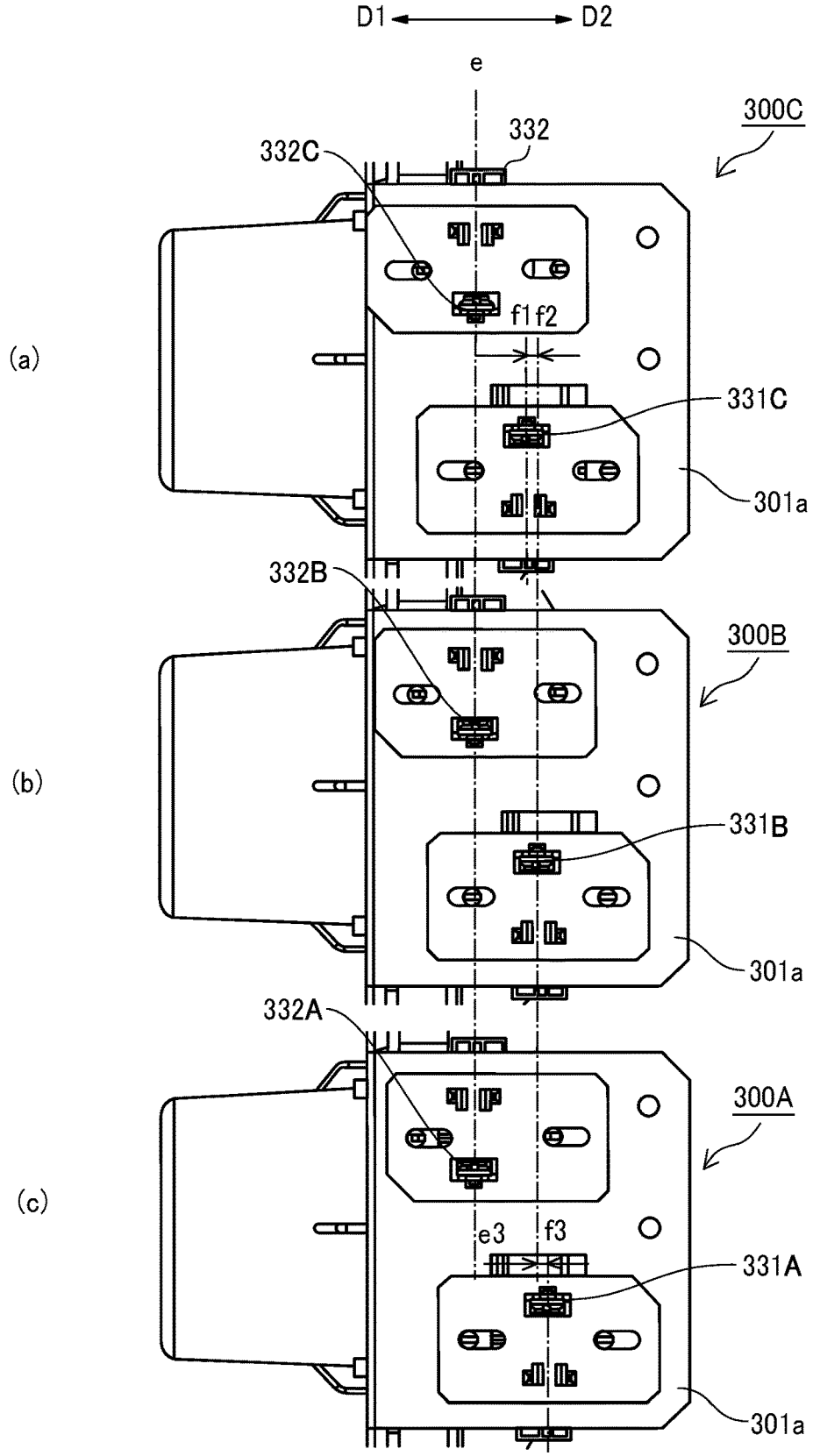
FIG. 13 is a schematic front view of the relative attachment positions (detection positions) of the upper limit sensors and the lower limit sensors of the plurality of the discharge units according to a second embodiment of the present disclosure similar to FIG. 9.

Next, a second embodiment of the present disclosure is described with reference to FIG. 13. FIG. 13 is a schematic front view of the upper limit sensors 331 and the lower limit sensors 332 of a plurality of the discharge units 33 according to the second embodiment similar to FIG. 9 in a view from the direction indicated by arrow "F" in FIG. 7. FIG. 13 illustrates the relative attachment position (detection position) of the upper limit sensors 331 and the lower limit sensors 332.

In the discharge unit 33 according to the second embodiment, the lower limit positions at which the lower limit sensors 332 detects the displacement member 320 are aligned at the same position as indicated by one-dot line "e." Thus, positions of the maximum values of the negative pressures in the sub tanks 300 (lower limits of the negative pressures) become the same position regardless of the inclination of the discharge unit 33. The same position may be a predetermined position (for example, a position around −2 kPa) at a predetermined value of the negative pressure.

In the above-described configuration, the sub tank 300B of the head 100 (discharge unit 33B) having a relatively large inclination angle (θ in FIG. 2) has a distance larger than a distance of the sub tank 300C of the head 100 (discharge unit 33C) having a relatively small inclination angle (zero in FIG. 2). The distance is between the upper limit position and the lower limit position of the amount of remaining liquid in the liquid container 302 of the sub tank 300.

Thus, a plurality of detector holders (sensor holders 330) are attached to the plurality of sub tanks 300. Each of the plurality of detector holders (sensor holders 330) attaches at least one of the plurality of upper limit detectors (upper limit sensors 331) and at least one of the plurality of lower limit detectors (lower limit sensors 332). The plurality of detector holders (sensor holders 330) are attached to the plurality of sub tanks 300 at different positions, and relative attachment positions of the plurality of upper limit detectors 331 and the plurality of lower limit detectors 332 to the plurality of sub tanks 300 are different.

Therefore, distances between the relative attachment positions of the plurality of upper limit detectors (upper limit sensors 331) and the plurality of lower limit detectors (lower limit sensors 332) are different. The first head 100 is inclined at a first angle (zero, for example) to a vertical direction, the second head 100 is inclined at a second angle (θ, for example) to the vertical direction. The second angle (θ, for example) is larger than the first angle (zero, for example). A first distance between relative attachment positions of the first upper limit detector (upper limit sensor 331) and the first lower limit detector (lower limit sensor 332) attached to the first sub tank 300C is smaller than a second distance between relative attachment positions of the second upper limit detector (upper limit sensor 331) and the second lower limit detector (lower limit sensor 332) attached to the second sub tank 300B.

Thus, the discharge unit 33 having a small inclination angle needs a large negative pressure so that a control range becomes narrow. The control range is a range (distance) from the lower limit position to the upper limit position of the amount of remaining liquid. Thus, a supply cycle from the main tank 500 is reduced to secure a large negative pressure in the sub tank 300. Thus, control ranges of pressures in the plurality of sub tanks 300 are different according to the different angles (zero, θ, and 2θ, for example, in FIG. 2) of the plurality of head units 200. Thus, the pressures in the plurality of sub tanks 300 are respectively controllable within different ranges according to the different angles of the plurality of head units 200.

Conversely, the discharge unit 33 having a large inclination angle can supply the liquid even with a small negative pressure in the sub tank 300. Thus, the discharge unit 33 can increase the supply cycle of liquid supply from the main tank 500 to reduce downtime associated with liquid supply.

Next, an example of a liquid supply system according to the second embodiment of the present disclosure is described with reference to FIGS. 14 and 15.

Figure 14:
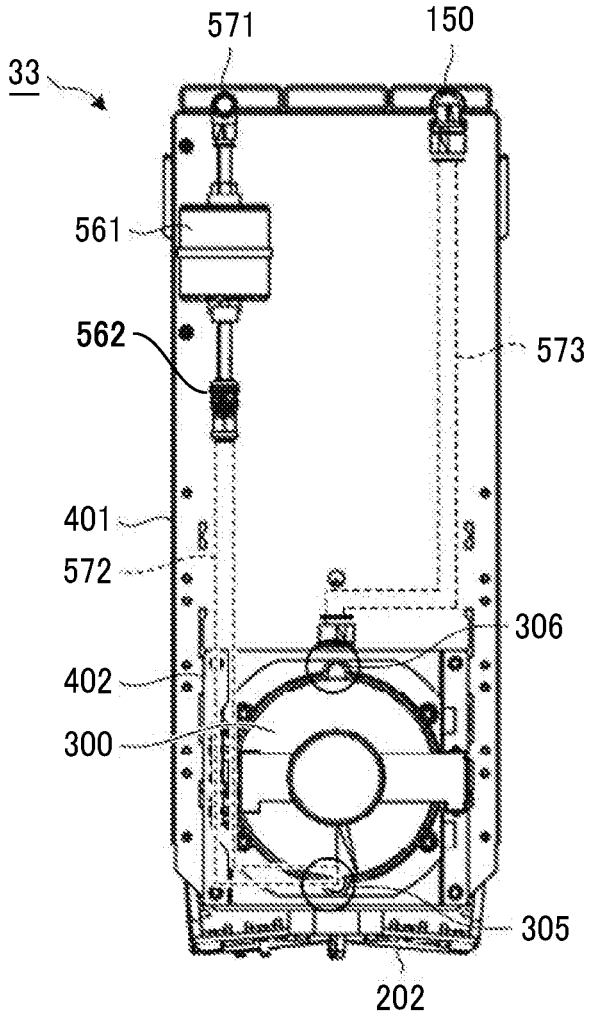
FIG. 14 is a schematic cross-sectional front view of the discharge unit according to the second embodiment illustrating an example of a liquid supply system.
Figure 15:
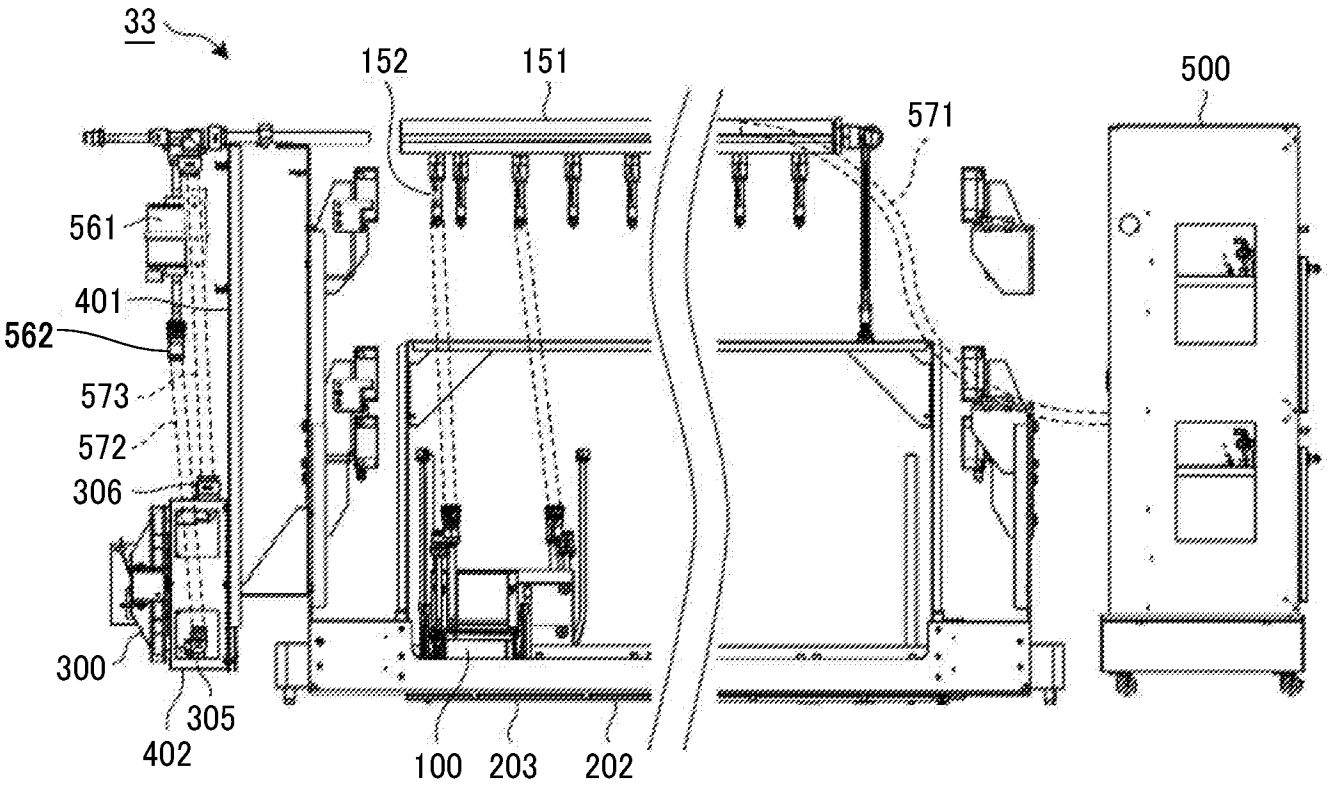
FIG. 15 is a schematic cross-sectional side view of the discharge unit including a main tank according to the second embodiment of the present disclosure.

FIG. 14 is a schematic cross-sectional front view of the discharge unit 33 according to the second embodiment. FIG. 15 is a schematic cross-sectional side view of the discharge unit 33 including a main tank 500 according to the nineteenth embodiment of the present disclosure.

The discharge unit 33 includes a plurality of heads 100 mounted on the base member 202 to be used during a printing process. A manifold 150 is arranged on a top of the discharge unit 33. The manifold 150 can distribute the liquid to each of the plurality of heads 100 from a common channel 151 of the manifold 150 through branch channels 152 to each of the plurality of heads 100 mounted at each mounting position 203.

The discharge unit 33 includes a main bracket 401 and a sub-bracket 402 attached to a plate on a front side of the discharge unit 33. The main bracket 401 and the sub-bracket 402 mount the sub tank 300.

The liquid stored in the main tank 500 is fed to each part through a pipe. Liquid is fed from the main tank 500 to a filter 561 by a supply pipe 571 (tube or the like). The liquid that has passed through the filter 561 is fed to the liquid supply port 305 located in a lower part of the sub tank 300 by a liquid supply pipe 572 and is refilled in the liquid container 302 of the sub tank 300.

The liquid in the sub tank 300 is fed from a liquid discharge port 306 located at an upper part of the sub tank 300 to the common channel 151 of the manifold 150 through a pipe 573. Then, the liquid is supplied to each of the heads 100 from a branch channel 152.

Figure 16:
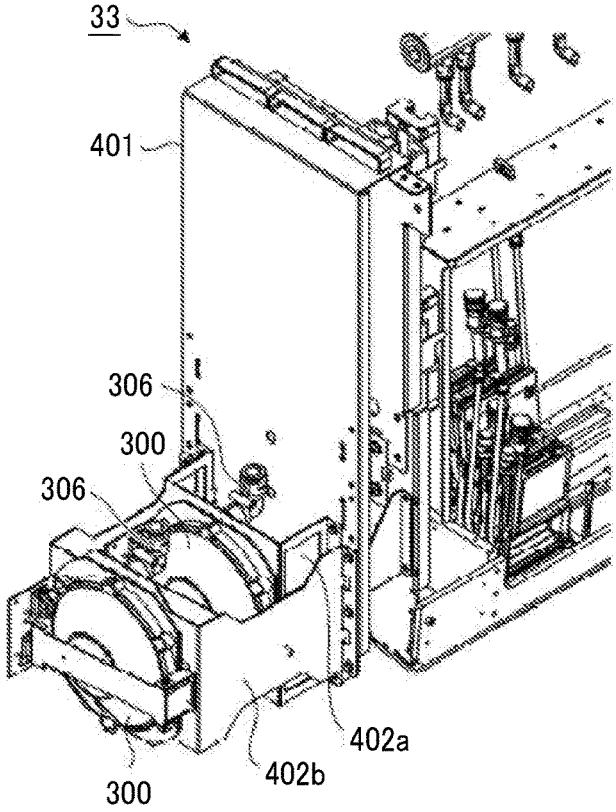
FIG. 16 is a schematic perspective view of the discharge unit illustrating another example of the liquid supply system.
Figure 17:
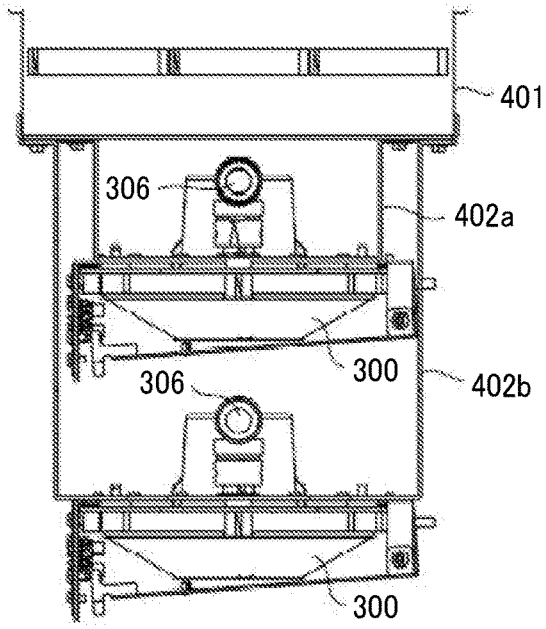
FIG. 17 is an enlarged schematic plan view of a main portion of the discharge unit.

Next, another example of the liquid supply system according to the second embodiment of the present disclosure is described with reference to FIGS. 16 and 17. FIG. 16 is a schematic perspective view of the discharge unit 33 according to another example of the second embodiment. FIG. 17 is a plan view of a main portion of the discharge unit 33.

The discharge unit 33 includes a sub-brackets 402*a* and 402*b*. Two sub tanks 300 are respectively attached to the sub-brackets 402*a* and 402*b* so that the liquid is supplied from the two sub tanks 300 to the head units 200.

Figure 18:
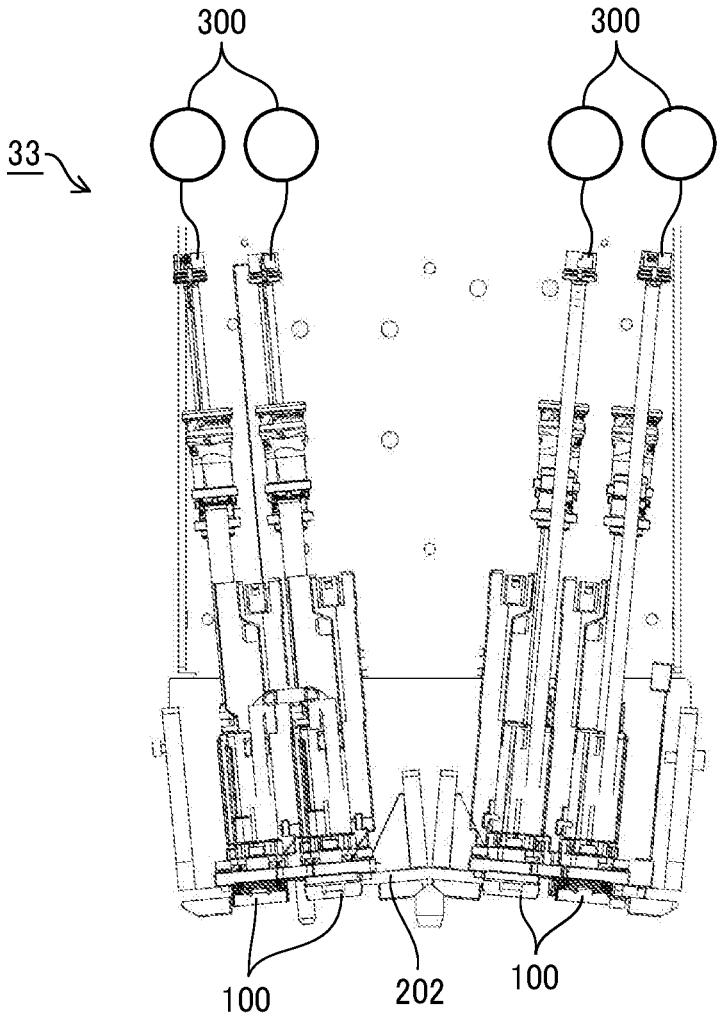
FIG. 18 is a schematic front view of the discharge unit of a first example of the discharge unit.
Figure 19:
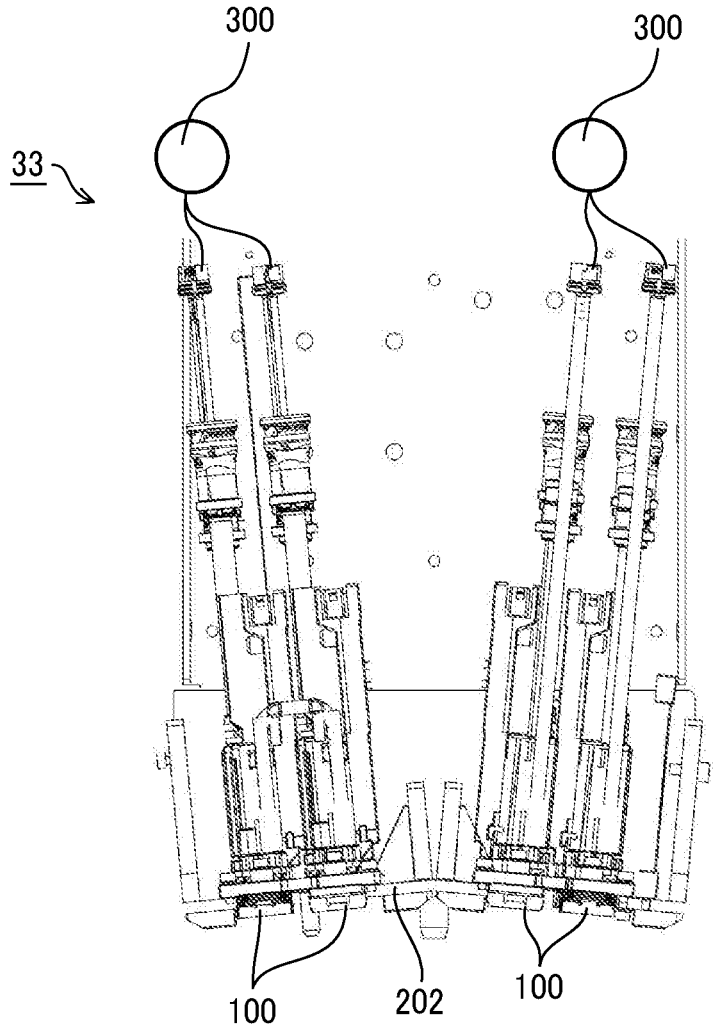
FIG. 19 is a schematic front view of the discharge unit of a second example of the discharge unit.

Next, still another example of the discharge unit according to the second embodiment of the present disclosure is described with reference to FIGS. 18 and 19. FIGS. 18 and 19 are schematic front views of the discharge unit 33 of the printer 1.

The discharge unit 33 of a first example illustrated in FIG. 18 can mount the heads 100 on the base member 202 so that a direction of the nozzle surface 101 of the head 100 is different between two rows of the heads 100 on one side (even side) and two rows of the heads 100 on another side (odd side) with a structure 204 in between as a boundary. In FIG. 18, the one side (even side) is a left side and another side (odd side) is a right side, for example.

The base member 202 is inclined at different angles on the left side (even side) and the right side (odd side) so that the nozzle surfaces 101 of the heads 100 face an outer peripheral surface of the drum 31 with the structure 204 in between as the boundary. Each head 100 mounted on the discharge unit 33 faces a direction in which the nozzle surfaces 101 face the outer peripheral surface of the drum 31 at each position with the structure 204 in between as the boundary.

The discharge unit 33 in the first example includes four sub tanks 300 in each row of the heads 100. Thus, four types of liquids (cyan C, magenta M, yellow Y, and black K, etc.) may be assigned to each row of the heads 100 to be used by the heads 100.

In a second example illustrated in FIG. 19, the discharge unit 33 includes two sub tanks 300. One side (left side) of the sub tank 300 supplies the liquid to two rows of the heads 100 on left side (even side). Another side (right side) of the sub tank 300 supplies the liquid to two rows of the heads 100 on right side (odd side). Thus, two types (two colors) of liquids may be respectively assigned to two rows of the heads 100 to be used by the heads 100.

Figure 20:
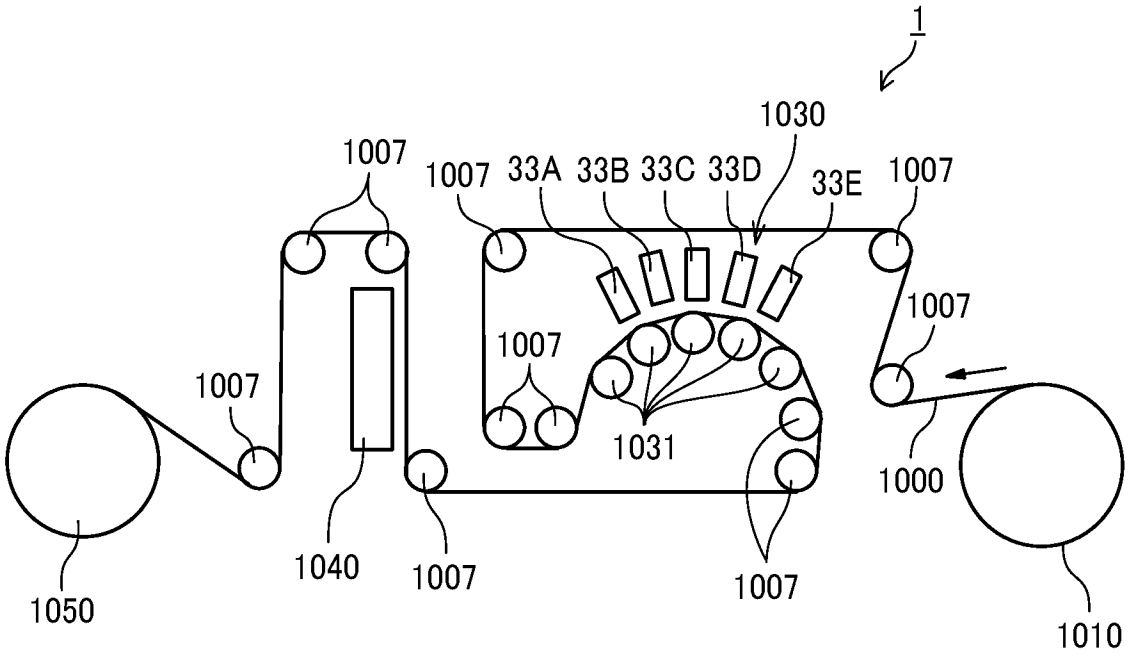
FIG. 20 is a schematic cross-sectional front view of a printer as a liquid discharge apparatus according to a third embodiment of the present disclosure.

Next, a liquid discharge apparatus according to a third embodiment of the present disclosure is described with reference to FIG. 20. FIG. 20 is a schematic cross-sectional front view of the printer 1 according to a third embodiment of the present disclosure.

The printer 1 guides a web 1000 such as continuous sheet fed from a feeding roll 1010 to a printing unit 1030 via a plurality of guide rollers 1007. The printing unit 1030 includes a plurality of guide rollers 1031 to guide the web 1000 while the web 1000 faces each discharge unit 33. Each discharge unit 33 discharges a desired liquid from the nozzles 104 of the heads 100 onto the web 1000 to print desired image on the web 1000.

Then, the dryer 1040 dries a print surface of the web 1000, onto which the image has been printed by the printing unit 1030, while guiding the web 1000 by the plurality of guide rollers 1007. The web 1000 dried by the dryer 1040 is wound around a winding roller 1050.

Although the sub tank 300 is arranged above the head 100 and the sub tank 300 and the head 100 are inclined in the above-described embodiments, the embodiment according to the present disclosure is not limited to such a configuration. For example, a plurality of head units 200 may be arranged without inclination, and the sub tanks 300 may be arranged above the heads 100.

However, the embodiment according to the present disclosure is applicable to a configuration in which heights of the sub tanks 300 are different between the heads 100. Further, although the sub tank 300 is arranged below the head 100 in the above-described embodiments, the embodiment according to the present disclosure is applicable to a configuration in which heights of the sub tanks 300 are different between the heads 100.

In the present embodiments, a "liquid" discharged from the head is not particularly limited as long as the liquid has a viscosity and surface tension of degrees dischargeable from the head. However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

Examples of the "liquid discharge apparatus" include, not only apparatuses capable of discharging liquid to materials to which liquid can adhere, but also apparatuses to discharge a liquid toward gas or into a liquid.

The "liquid discharge apparatus" may include units to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can adhere" represents a material on which liquid is at least temporarily adhered, a material on which liquid is adhered and fixed, or a material into which liquid is adhered to permeate. Examples of the "material on which liquid can adhere" include recording media, such as paper sheet, recording paper, recording sheet of paper, film, and cloth, electronic component, such as electronic substrate and piezoelectric element, and media, such as powder layer, organ model, and testing cell. The "material on which liquid can adhere" includes any material on which liquid is adhered, unless particularly limited.

Examples of the "material on which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material on which liquid can adhere. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on the surface of the sheet to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:

a plurality of head units configured to discharge liquids;

a plurality of sub tanks configured to respectively store the liquids to be supplied to the plurality of head units, each sub tank storing liquid for a different head unit; and a plurality of upper limit detectors configured to respectively detect upper limits of remaining amounts of liquid in the plurality of sub tanks, wherein at least two of the plurality of upper limit detectors, of corresponding at least two of the plurality of sub tanks storing liquid for different head units, detect different upper limits of remaining amounts of liquid in the at least two of the plurality of sub tanks, wherein the plurality of head units and the plurality of sub tanks are inclined at different angles to a vertical direction, and inner capacities of the plurality of sub tanks are different according to the different angles of the plurality of head units.

2. The liquid discharge apparatus according to claim 1, wherein the plurality of head units includes:

a first head unit; and a second head unit, and the plurality of sub tanks includes:

a first sub tank configured to store a liquid to be supplied to the first head unit; and a second sub tank configured to store a liquid to be supplied to the second head unit, and the plurality of upper limit detectors includes:

a first upper limit detector configured to detect a first upper limit of a remaining amount of liquid in the first sub tank; and a second upper limit detector configured to detect a second upper limit of a remaining amount of liquid in the second sub tank, the second upper limit being larger than the first upper limit.

3. The liquid discharge apparatus according to claim 2, wherein a first water head difference between the first head unit and the first sub tank is larger than a second water head difference between the second head unit and the second sub tank.

4. The liquid discharge apparatus according to claim 3, wherein the first head unit is inclined at a first angle to a vertical direction, and the second head unit is inclined at a second angle to the vertical direction, the second angle being larger than the first angle.

5. The liquid discharge apparatus according to claim 4, wherein the first angle is zero degree and the first head unit is aligned with the vertical direction, and the second head unit is inclined at the second angle to the first head unit.

6. The liquid discharge apparatus according to claim 2, further comprising:

a plurality of lower limit detectors configured to respectively detect lower limits of remaining amounts of liquid in the plurality of sub tanks, the plurality of lower limit detectors includes:

a first lower limit detector configured to detect a first lower limit of a remaining amount of liquid in the first sub tank; and a second lower limit detector configured to detect a second lower limit of a remaining amount of liquid in the second sub tank, the second lower limit being larger than the first lower limit.

7. The liquid discharge apparatus according to claim 6, wherein a first water head difference between the first head unit (200C) and the first sub tank (300C) is larger than a second water head difference between the second head unit (200B) and the second sub tank (300B).

8. The liquid discharge apparatus according to claim 7, wherein the first head unit is inclined at a first angle to a vertical direction, and the second head unit is inclined at a second angle to the vertical direction, the second angle being larger than the first angle.

9. The liquid discharge apparatus according to claim 6, further comprising:

a plurality of detector holders attached to the plurality of sub tanks, at least one of the plurality of upper limit detectors and the plurality of lower limit detectors attached to each of the plurality of detector holders, wherein relative attachment positions of the plurality of detector holders to the plurality of sub tanks are different, and relative attachment positions of the plurality of upper limit detectors and the plurality of lower limit detectors to the plurality of sub tanks are different.

10. The liquid discharge apparatus according to claim 9, wherein distances between the relative attachment positions of the plurality of upper limit detectors and the plurality of lower limit detectors are different, the first head unit is inclined at a first angle to a vertical direction, the second head unit is inclined at a second angle to the vertical direction, the second angle being larger than the first angle, and a first distance between relative attachment positions of the first upper limit detector and the first lower limit detector attached to the first sub tank is smaller than a second distance between relative attachment positions of the second upper limit detector and the second lower limit detector attached to the second sub tank.

11. The liquid discharge apparatus according to claim 1, wherein pressures in the plurality of sub tanks are respectively controllable within different ranges according to the different angles of the plurality of head units.

* * * * *